US007644922B2

(12) United States Patent
Fiden et al.

(10) Patent No.: US 7,644,922 B2
(45) Date of Patent: Jan. 12, 2010

(54) GAMING TERMINAL WITH TRANSFORMABLE CABINET

(75) Inventors: Daniel Fiden, Half Moon Bay, CA (US); Matt Fitzsimons, Lake in the Hills, IL (US); Lisa Helfer, Chicago, IL (US); Steve Lee, Naperville, IL (US)

(73) Assignee: WMS Gaming Inc., Waukegan, IL (US)

( * ) Notice: Subject to any disclaimer, the term of this patent is extended or adjusted under 35 U.S.C. 154(b) by 546 days.

(21) Appl. No.: 11/149,857

(22) Filed: Jun. 10, 2005

(65) Prior Publication Data

US 2005/0277468 A1 Dec. 15, 2005

Related U.S. Application Data

(60) Provisional application No. 60/579,371, filed on Jun. 14, 2004.

(51) Int. Cl.
*A63F 71/00* (2006.01)

(52) U.S. Cl. ..... 273/138.1; 463/16

(58) Field of Classification Search ..... None
See application file for complete search history.

(56) References Cited

U.S. PATENT DOCUMENTS 4,009,918 A * 3/1977 MacDonald et al. ..... 312/351.3
4,517,706 A * 5/1985 Lautenschlager et al. ..... 16/238
4,756,580 A * 7/1988 Middleton, Jr. ..... 312/7.2
4,961,766 A * 10/1990 Hogan ..... 55/385.2
5,813,914 A * 9/1998 McKay et al. ..... 463/46
6,203,429 B1 * 3/2001 Demar et al. ..... 463/20
6,514,145 B1 * 2/2003 Kawabata et al. ..... 463/46
D493,846 S * 8/2004 Seelig et al. ..... D21/370
7,182,689 B2 * 2/2007 Hughs-Baird et al. ..... 463/20
7,184,277 B2 * 2/2007 Beirne ..... 361/807
7,195,559 B2 * 3/2007 Gilmore et al. ..... 463/20
7,198,570 B2 * 4/2007 Rodgers et al. ..... 463/20
7,217,189 B2 * 5/2007 Kaminkow ..... 463/20

(Continued)

FOREIGN PATENT DOCUMENTS

JP 2005342358 * 12/2005

OTHER PUBLICATIONS www.strictlyslots.com/archive/0509ss/legato_slots.html.*

*Primary Examiner*—Gene Kim
*Assistant Examiner*—Dolores Collins
(74) *Attorney, Agent, or Firm*—Nixon Peabody LLP

(57) ABSTRACT

The invention relates to a method and system for operating a gaming terminal where the gaming terminal cabinet itself is an active feature or element of the wagering game. The method and system of the invention involve a gaming terminal cabinet that is transformable from a primary external configuration to a secondary external configuration. The transformation of the gaming terminal cabinet may be based on an outcome of a basic wagering game, a bonus wagering game, or both. The secondary external configuration may involve a single transformation or it may involve multiple transformations. At the end of the wagering game, the gaming terminal cabinet may be transformed back into the primary external configuration. The transformation of the gaming terminal cabinet may also be used to attract the attention of passersby when the gaming terminal is idle to thereby generate interest in the gaming terminal.

19 Claims, 8 Drawing Sheets

U.S. PATENT DOCUMENTS

| | | | | |
|---|---|---|---|---|
| 7,229,350 | B2 * | 6/2007 | Baerlocher et al. | 463/20 |
| 7,235,001 | B2 * | 6/2007 | Miyashita et al. | 463/25 |
| 7,235,009 | B2 * | 6/2007 | Baerlocher | 463/16 |
| 7,235,011 | B2 * | 6/2007 | Randall et al. | 463/25 |
| 7,247,093 | B2 * | 7/2007 | Rothkranz | 463/16 |
| 2004/0248647 | A1 * | 12/2004 | Rothschild et al. | 463/30 |
| 2004/0248648 | A1 * | 12/2004 | Rothschild et al. | 463/31 |
| 2005/0003879 | A1 * | 1/2005 | Jaffe et al. | 463/16 |
| 2005/0143161 | A1 * | 6/2005 | Kukita | 463/17 |
| 2005/0159205 | A1 * | 7/2005 | Kukita | 463/17 |
| 2005/0192090 | A1 * | 9/2005 | Muir et al. | 463/30 |
| 2005/0277477 | A1 * | 12/2005 | Hajder et al. | 463/46 |
| 2006/0272885 | A1 * | 12/2006 | Lee | 181/199 |
| 2006/0281559 | A1 * | 12/2006 | Luciano | 463/46 |

* cited by examiner

GAMING TERMINAL WITH TRANSFORMABLE CABINET

CROSS-REFERENCE TO RELATED APPLICATION

This application for patent claims priority to, and hereby incorporates by reference, U.S. Provisional Application Ser. No. 60/579,371, entitled "Gaming Terminal With Transformable Cabinet," filed on Jun. 14, 2004 with the United States Patent and Trademark Office.

FIELD OF THE INVENTION

The present invention relates generally to gaming terminals and, more particularly, to a method and system of operating a gaming terminal having a transformable cabinet.

BACKGROUND OF THE INVENTION

Gaming terminals, such as slot machines, video poker machines, and the like, have been a cornerstone of the gaming industry for several years. Generally, the popularity of such terminals among players depends on the perceived likelihood of winning money at the terminal and the intrinsic entertainment value of the terminal relative to other available gaming options. Where the available gaming options include a number of competing terminals and the expectation of winning each terminal is roughly the same (or believed to be the same), players are likely to be attracted to the more entertaining and exciting of the terminals.

Consequently, gaming terminal operators strive to employ the most entertaining and exciting terminals available because such terminals attract frequent play and, hence, increase profitability for the operators. Thus, in the highly competitive gaming terminal industry, there is a continuing need to develop new types of games, or improvements to existing games, that will enhance the entertainment value and excitement associated with the games.

One concept that has been successfully employed in existing gaming terminals to enhance player entertainment is the use of progressive games. In the gaming industry, a "progressive" game involves collecting coin-in data from participating gaming device(s) (e.g., slot machines), contributing a percentage of that coin-in data to a progressive jackpot amount, and awarding that jackpot amount to a player upon the occurrence of a certain jackpot-won event. A jackpot-won event typically occurs when a "progressive winning position" is achieved at a participating gaming device. If the gaming device is a slot machine, a progressive winning position may, for example, correspond to alignment of progressive jackpot reel symbols along a certain payline. The initial progressive jackpot is a predetermined minimum amount. That jackpot amount, however, progressively increases as players continue to play the gaming machine without winning the jackpot. Further, when several gaming machines are linked together such that several players at several gaming machines compete for the same jackpot, the jackpot progressively increases at a much faster rate, which leads to further player excitement.

Another concept that has been employed is that of a secondary or "bonus" game which may be played in conjunction with a "basic" game. The bonus game may include any type of game, either similar to or entirely different from the basic game, and is initiated by the occurrence of certain pre-selected events or outcomes of the basic game. Such a bonus game has been found to produce a significantly higher level of player excitement than the basic game alone because it provides an additional chance to play, which increases the player's overall expectation of winning.

In existing gaming terminals, the cabinet that houses the various components (e.g., displays, wager intake, hopper, electronics, etc.) of the gaming terminal has an essentially fixed external configuration. That is, the size, shape, aspect ratio, and other physical attributes of the cabinet does not change during or after the wagering game. Some gaming terminal cabinets may have external configurations that reflect a particular theme and may include lights that flash and change colors according to the outcome of the wagering game, but the external configuration of these cabinets do not change. As such, existing gaming terminal cabinets are not a feature or element, or are only a passive element, of the wagering game.

Accordingly, what is needed is a gaming terminal that is capable of providing increased excitement and entertainment value over existing gaming terminals. More specifically, what is needed is a gaming terminal where the cabinet itself is an active feature or element of the wagering game.

SUMMARY OF THE INVENTION

The present invention is directed to a method and system for operating a gaming terminal where the gaming terminal cabinet itself is an active feature or element of the wagering game. The method and system of the invention involves a gaming terminal cabinet that is transformable from a primary external configuration to a secondary external configuration. The transformation of the gaming terminal cabinet may be based on an outcome of a basic wagering game, or it may be based on an outcome of a bonus wagering game, or both. The secondary external configuration may include a single transformation or it may include multiple transformations. At the end of the wagering game, the gaming terminal cabinet may be transformed back to the primary external configuration. The transformation of the gaming terminal cabinet may also be used to attract the attention of passersby when the gaming terminal is idle and thereby generate interest in the gaming terminal.

In general, in one aspect, the invention is directed to a gaming terminal having a physically transformable cabinet. The gaming terminal comprises a first display configured to display a randomly selected outcome from a wagering game, the randomly selected outcome being selected from a plurality of outcomes in response to receiving a wager input, the plurality of outcomes including at least one special event outcome. The gaming terminal further comprises a cabinet for supporting the first display, the cabinet having a primary external configuration and a secondary external configuration, the primary external configuration being physically different from the secondary external configuration. Mechanical actuators are mounted in the cabinet for transforming the cabinet from the primary external configuration to the secondary external configuration upon occurrence of one of the at least one special event outcome in the wagering game.

In general, in another aspect, the invention is directed to a method of operating a gaming terminal having a physically transformable cabinet. The method comprises the steps of accepting a wager input for a wagering game and displaying a randomly selected outcome for the wagering game on a first display of the gaming terminal in response to the wager input, the randomly selected outcome selected from a plurality of outcomes that includes at least one special event outcome. The method further comprises physically transforming the gaming terminal from a primary external configuration to a secondary external configuration upon occurrence of one of the at least one special event outcome in the wagering game, the primary external configuration being physically different from the secondary external configuration.

In general, in yet another aspect, the invention is directed to a gaming terminal having an elongated top portion. The gaming terminal comprises a first display configured to display a randomly selected outcome from a basic wagering game, the randomly selected outcome being selected from a plurality of outcomes in response to receiving a wager input, the plurality of outcomes including at least one start-bonus outcome. The gaming terminal further comprises a second display configured to display a bonus game upon occurrence of one of the at least one start-bonus game outcome in the basic wagering game. A cabinet having a top portion is also present for housing the first display and the second display, and mechanical actuators are mounted in the gaming terminal for elongating the top portion of the cabinet upon occurrence of one of the at least one start-bonus game outcome such that the second display is moved from a non-viewing position to a viewing position.

In general, in still another aspect, the invention is directed to a method of operating a gaming terminal having an elongated top portion. The method comprises accepting a wager input for the basic wagering game and displaying a randomly selected outcome for the basic wagering game on a first display of the gaming terminal in response to the wager input, the randomly selected outcome selected from a plurality of outcomes that includes at least one start-bonus outcome. The method further comprises raising a top portion of the gaming terminal from a retracted position to an extended position upon occurrence of one of the at least one start-bonus game outcome in the basic wagering game. A bonus game is displayed on a second display mounted in the top portion of the gaming terminal upon occurrence of one of the at least one start-bonus game outcome in the basic wagering game, the second display moved from a non-viewing position to a viewing position when the top portion is raised.

In general, in yet another aspect, the invention is directed to a gaming terminal having a physically manifested game theme. The gaming terminal comprises a first display configured to display a randomly selected outcome from the basic wagering game, the randomly selected outcome being selected from a plurality of outcomes in response to receiving a wager input, the plurality of outcomes including at least one start-bonus outcome. The gaming terminal further comprises a predefined theme object, the predefined theme object indicative of a theme of the basic wagering game. Mechanical actuators are mounted in the gaming terminal for moving the predefined theme object from a concealed position in the gaming terminal to an unconcealed position on top of the gaming terminal upon occurrence of one of the at least one start-bonus game.

In general, in still another aspect, the invention is directed to a method of operating a gaming terminal having a physically manifested game theme. The method comprises accepting a wager input for the basic wagering game and displaying a randomly selected outcome for the basic wagering game in response to the wager input, the randomly selected outcome selected from a plurality of outcomes that includes at least one start-bonus outcome. The method further comprises starting a bonus game upon occurrence of one of the at least one start-bonus game outcome in the basic wagering game, and raising a predefined theme object from a concealed position in the gaming terminal to an unconcealed position on top of the gaming terminal upon starting the bonus game, the predefined theme object indicative of a theme of the basic wagering game.

In general, in yet another aspect, the invention is directed to a method for attracting attention in a gaming terminal having a physically transformable cabinet. The method comprises detecting when no one is playing the gaming terminal, and repeatedly transforming the gaming terminal from a primary external configuration to a secondary external configuration and back to the primary external configuration, the primary external configuration being physically different from the secondary external configuration.

The above summary of the present invention is not intended to represent each embodiment or every aspect of the present invention. The detailed description and figures will describe many of the embodiments and aspects of the present invention.

BRIEF DESCRIPTION OF THE DRAWINGS

The foregoing and other advantages of the invention will become apparent upon reading the following detailed description and upon reference to the drawings.

Figure 1:
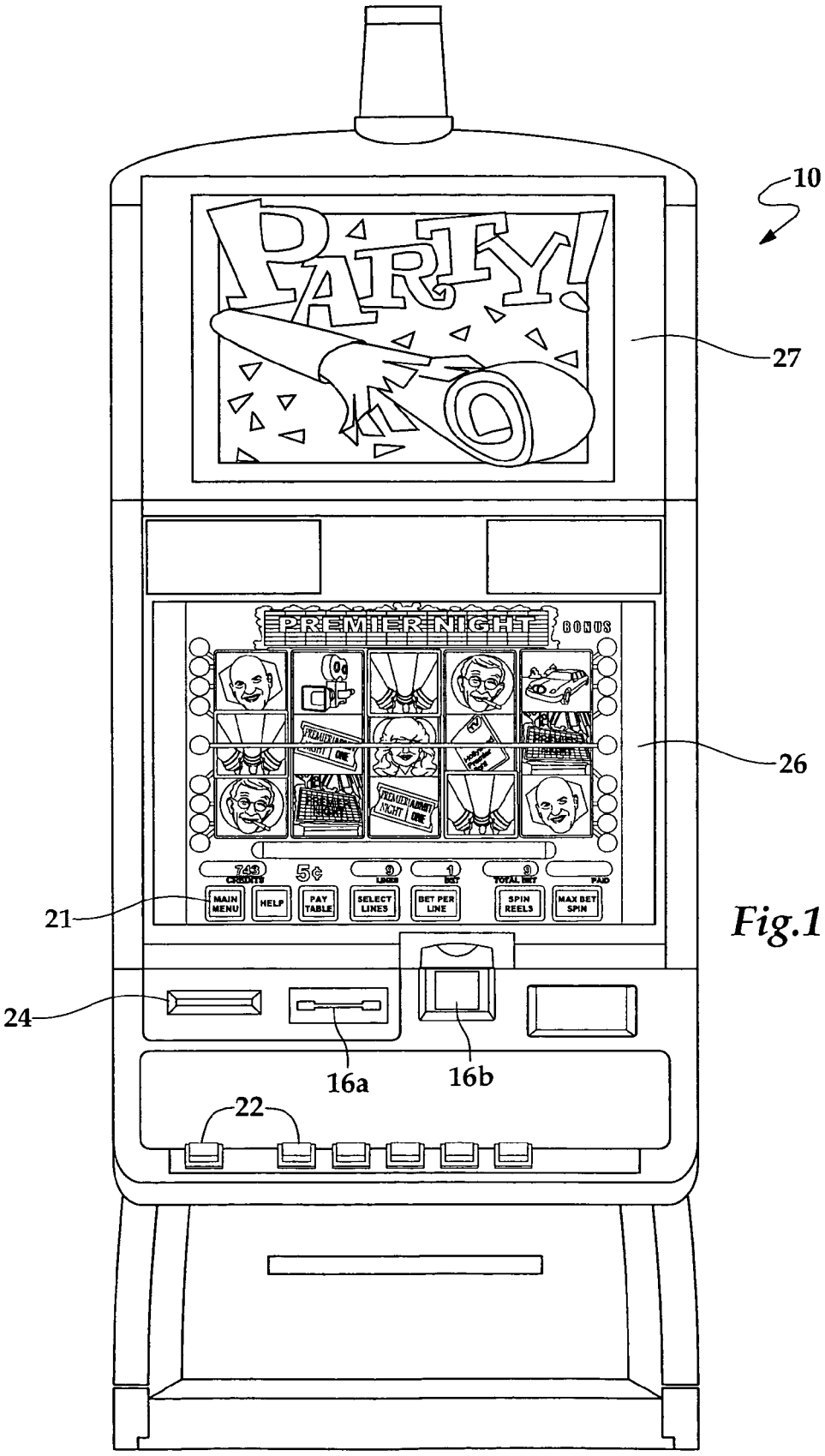
FIG. 1 illustrates a gaming terminal having a transformable cabinet according to one embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

As mentioned above, embodiments of the invention provide a method and system for operating a gaming terminal where the cabinet of the gaming terminal is an active feature or element of the wagering game. In particular, the method and system of the invention uses a gaming terminal cabinet that changes its external configuration based on the outcome of the game being played. The game being played may be a basic wagering game in some embodiments, or it may be a bonus game in other embodiments. In either case, the cabinet may be returned to its original external configuration after the game is concluded.

FIG. 1 shows a perspective view of an exemplary gaming terminal 10 according to embodiments of the invention. The gaming terminal 10 may be operated as a stand-alone terminal, or it may be connected to a network of gaming terminals. Further, the gaming terminal 10 may be any type of gaming terminal and may have varying structures and methods of operation. For example, the gaming terminal 10 may be a mechanical gaming terminal configured to play mechanical slots, or it may be an electromechanical or electrical gaming terminal configured to play a video casino game, such as blackjack, slots, keno, poker, etc. In the example shown, the gaming terminal 10 is a video slot machine.

As shown, the gaming terminal 10 has a physically transformable cabinet 12 that includes a number of typical gaming terminal components, such as wager acceptors 16*a* and 16*b*, touch screen buttons 21, and push-buttons 22. In some embodiments, a player-identification card reader 24 may also be present for identifying players and tracking their play on the cabinet 12. A main display 26 is housed in the cabinet 12 for displaying the basic wagering game and, in some cases, also the bonus game. While these typical components found in the gaming terminal 10 are described below, it should be understood that numerous other elements may exist and may be used in any number of combinations to create various forms of a gaming terminal.

The wager acceptors 16*a* and 16*b* may be provided in many forms, including a card wager acceptor 16*a* and a cash wager acceptor 16*b*. The cash wager acceptor 16*b* may include a coin slot acceptor or a note acceptor to input value to the gaming terminal 10. The card wager acceptor 16*a* may include a card-reading device for receiving a stored value card and reading a recorded monetary value associated with the card. The card wager acceptor 16*a* may also receive a card that authorizes a transfer of money from a player's credit or banking account to the gaming terminal 10.

The player-identification card reader 24, if present, is designed to read an identification card and extract information therefrom regarding the player's identity. The identification may then be used by casinos for rewarding certain players with complimentary services or special offers. For example, a player may be enrolled in a players' club and may be awarded certain complimentary services as that player collects points in his or her player-tracking account. When the player inserts his or her card into the player-identification card reader 24, the casino's computers can register that player's wagering at the gaming terminal 10. These and other perks are usually available only to players who are part of a special group of people, such as the casino's player's club.

The push buttons 22, which may be mechanical push buttons, allow players to select various options with respect to the games played on the gaming terminal 10. The touch screen buttons 21 located over the main display 26 serve similar functions.

The main display 26 displays the outcome of the basic wagering game (or the bonus game in some cases) and may take a variety of forms. For example, the main display 26 may be a conventional 3-slot mechanical reel, or it may take the form of a cathode ray tube (CRT), a liquid crystal display (LCD), a plasma display, or any other type of display that is suitable for simulating a 3-slot mechanical reel.

In one exemplary embodiment of the invention, physical transformation of the cabinet 12 takes place in the form of an elongated top portion 27. The transformation of the cabinet 12 depends on whether the outcome of the basic wagering game is one of the at least one start-bonus outcome. Thus, when the outcome of the basic wagering game is not one of the at least one start-bonus outcome, the cabinet 12 is in a basic external configuration, with the top portion 27 retracted partly or mostly into the cabinet walls. However, when the outcome of the basic wagering game is a predetermined one of the at least one start-bonus outcome, the cabinet 12 is transformed into a bonus external configuration, with the top portion 27 extended above the cabinet 12.

A secondary display (not visible here) is mounted in the cabinet 12 and hidden within the top portion 27. As the top portion 27 is extended, the secondary display is moved from a concealed or non-viewing position to an unconcealed or viewing position for displaying the bonus game. At the completion of the bonus game, the top portion 27 and the secondary display are retracted back into the cabinet 12. In this manner, the cabinet 12 is more than simply a housing for the gaming terminal 10, but is actually an active feature or element of the wagering game, thus adding to the excitement and enjoyment of the player and thereby increasing the entertainment value of the gaming terminal 10.

The transformable cabinet 12 may also create substantial interest in the gaming terminal 10 from nearby players and passersby who are likely to see and become fascinated by the top portion 27 rising up and down. The interest may be created while the gaming terminal 10 is being played, or when it is in a so-called "attract" mode. The attract mode is a mode that the gaming terminal 10 goes into when it detects that there is no one playing the gaming terminal 10, i.e., when the gaming terminal 10 is idle. During this mode, the transformable cabinet 12 automatically and repeatedly transforms the transformable cabinet 12 between an extended physical configuration and a retracted physical configuration as an attention-grabbing feature without regard to the outcome of any basic or bonus game (since no one is playing the gaming terminal 10). When the gaming terminal 10 detects that a player has begun playing again, it automatically exits the attract mode and resumes normal operation.

Figure 2A:
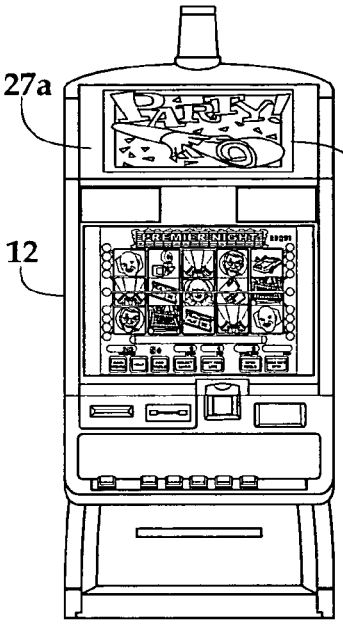
FIG. 2 illustrates a front view of the gaming terminal of FIG. 1 being transformed.
Figure 2B:
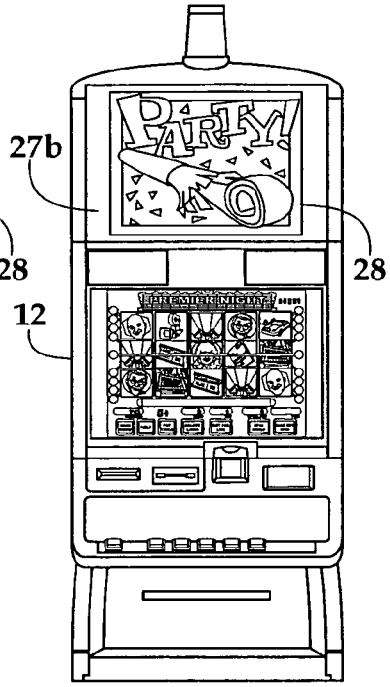
Figure 2C:
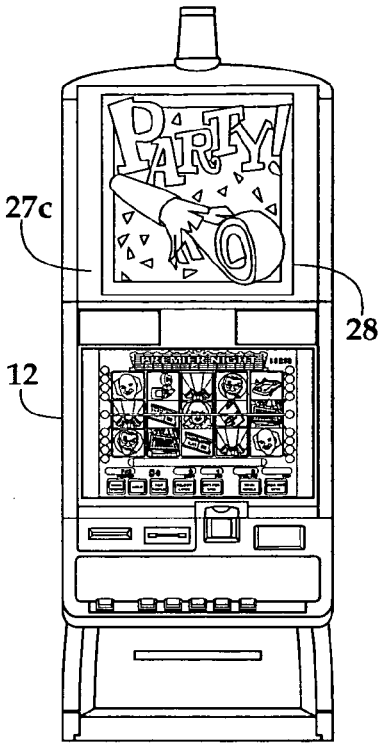

FIG. 2 illustrates a front view of the gaming terminal 10 as the top portion 27 of the cabinet 12 progresses from a retracted position to an extended position. Upon occurrence of one of the at least one start-bonus game outcome in the basic wagering game, the top portion 27 is raised from a retracted position (27*a*) through an intermediate position (27*b*) to an extended position (27*c*). While the top portion 27 is being extended, a secondary display 28 is gradually revealed from a hidden position within the cabinet 12 until it is in full view by the time the top portion 27 is fully extended.

Figure 3A:
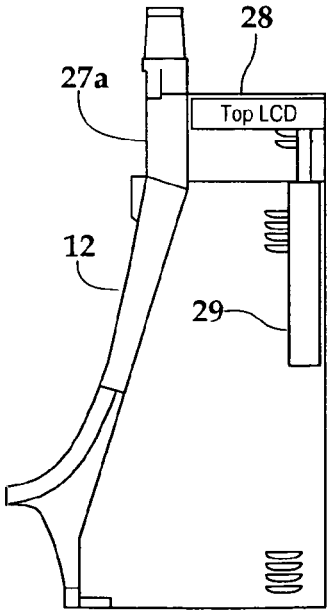
FIG. 3 illustrates a side view of the gaming terminal of FIG. 1 being transformed.
Figure 3B:
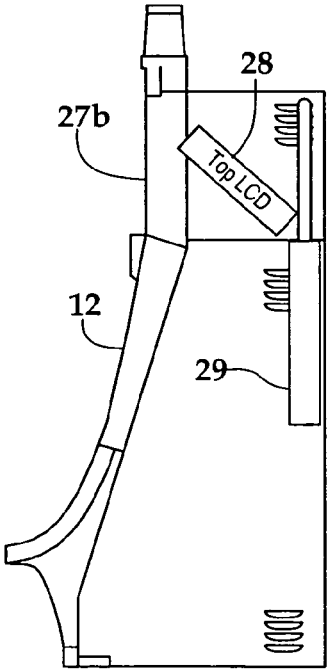
Figure 3C:
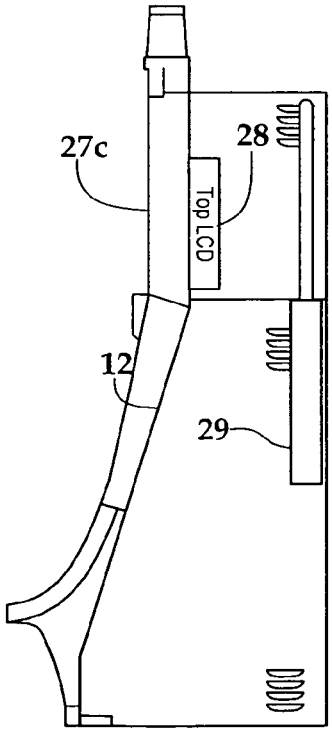

FIG. 3 illustrates a side view of the gaming terminal 10 as the top portion 27 of the cabinet 12, again, is extended from a retracted position (27*a*) through an intermediate position (27*b*) to an extended position (27*c*). As can be seen, while the top portion 27 is being extended, a secondary display 28 is gradually revealed from a hidden position within the cabinet 12. In the embodiment shown, the secondary display 28 is a flat panel LCD that is mounted horizontally to the inside of the top portion 27 underneath the top surface of the top portion 27 while the top portion 27 is in the retracted position (27*a*). Preferably, the secondary display/LCD 28 is mounted on hinges (not expressly shown) that allow the secondary display 28 to rotate from the horizontal position to a vertical position in the manner shown, and vice versa. Then, as the top portion 27 is extended, the secondary display/LCD 28 is slowly rotated (or lowered) on the hinges until it is in the vertical position when the top portion 27 is in the extended position (27*c*).

Although an LCD is described above for the secondary display 28, other suitable types of displays known to those of ordinary skill in the art may certainly be used without departing from the scope of the invention. Likewise, although hinges are described above for mounting the secondary display 28, other suitable types of mounting mechanisms known to those of ordinary skill in the art may also be used without departing from the scope of the invention.

To extend and retract the top portion 27, in some embodiments, linear actuators 29 (only one is shown) may be used to raise and lower the top portion 27 relative to the cabinet 12. In such embodiments, the top portion 27 may rest on the linear actuators 29 and may be guided by guides or rails mounted either on the inside or on the outside of the cabinet 12 such that the top portion 27 may be extended and retracted in a deliberate and controlled manner. The linear actuators 29 may be hydraulic actuators, pneumatic actuators, or other types of actuators commonly used to perform similar functions. Other techniques known to those having ordinary skill in the art may also be used to raise and lower the top portion 27 without departing from the scope of the invention.

In operation, upon occurrence of a certain start-bonus outcome in the basic wagering game, for example, three in a row of any symbol, the gaming terminal 10 causes the linear actuators 29 to raise the top portion 27 of the cabinet 12. As the top portion 27 is raised, the secondary display 28 is unfolded from its concealed position to become fully viewable along with any lights or signage that might be attached to the secondary display 28. The bonus game is then started and played on the secondary display 28 in the usual manner. After the bonus game is finished, the gaming terminal 10 causes the linear actuators 29 to lower the top portion 27, thereby folding the secondary display 28 back into its concealed and non-viewable position.

In some embodiments, instead of or in addition to an elongated top portion 27, the physical transformation of the cabinet 12 may take place in the form of theme objects that extend from the top of the cabinet 12. FIGS. 4-14 illustrate an exemplary implementation according to this embodiment of the invention. The implementation illustrated in FIGS. 4-14 is directed to a gaming terminal having a "dream house" theme where players try to add value to a house before selling it. It should be understood, however, that the invention is not limited to this theme only, but that other themes (e.g., dream car, dream vacation, etc.) may also be used without departing from the scope of the invention.

Figure 4:
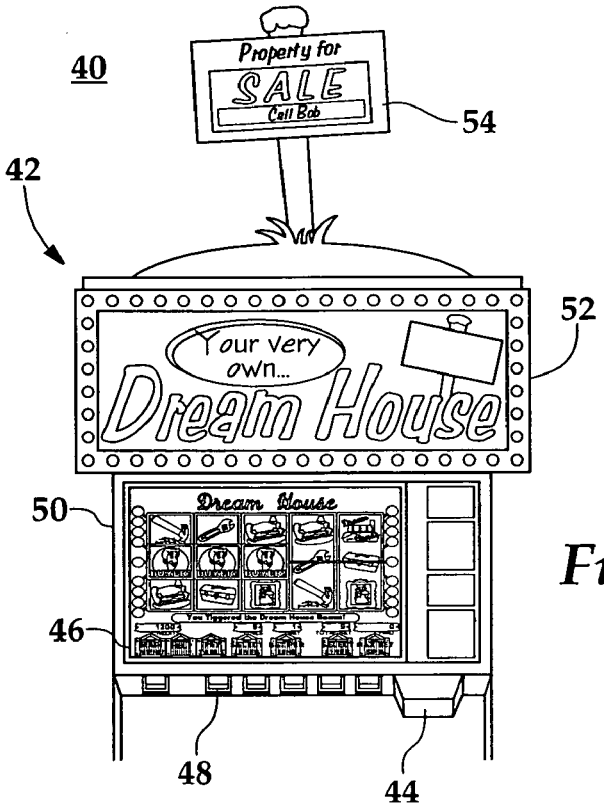
FIG. 4 illustrates a perspective view of another gaming terminal having a transformable cabinet according to one embodiment of the present invention.

Referring now to FIG. 4, a gaming terminal 40 according to embodiments of invention is shown. The gaming terminal 40 is similar to the gaming terminal 10 (see FIG. 1) in that it may be operated as a stand-alone terminal, or it may be connected to a network of gaming terminals. Further, the gaming terminal 40 may be any type of gaming terminal and may have varying structures and methods of operation. For example, the gaming terminal 40 may be a mechanical gaming terminal configured to play mechanical slots, or it may be an electromechanical or electrical gaming terminal configured to play a video casino game, such as blackjack, slots, keno, poker, etc. In the example shown, the gaming terminal 40 is a video slot machine.

As shown, the gaming terminal 40 has a physically transformable cabinet 42 that includes a number of typical gaming terminal components, such as wager acceptors 44, touch screen buttons 46, push-buttons 48, and the like. In some embodiments, a player-identification card reader (not expressly shown) may also be present for identifying players and tracking their play on the gaming terminal 40. A main display 50 is housed in the cabinet 42 for displaying a basic wagering game and, in this case, also a bonus game. A top portion 52 of the cabinet 42 may be used for supporting signage, flashing lights, and the like. It is also possible, of course, to have a secondary display mounted in the top portion 52 (which may or may not extendable) for displaying the bonus game instead of the signage and flashing lights shown here.

In accordance with embodiments of the invention, the cabinet 42 may be transformed between a basic external configuration and a bonus extra configuration upon occurrence of one of the at least one start-bonus outcome. In the basic external configuration, the cabinet 42 has no particularly noticeable or distinguishing features other than the colors, lights, and artwork that make up the theme of the gaming terminal 40. In some embodiments, it is possible for the basic external configuration to include a default theme object 54 protruding from the top portion 52 of the cabinet 42. In the bonus external configuration, the cabinet 42 has one or more theme objects extending from the top portion 52 of the cabinet 42 that represent various levels of monetary value (including no monetary value) to be awarded to players. The theme objects may include 2-dimensional octane objects or include 3-dimensional theme objects, or both. In the implementation shown here, the theme of the gaming terminal 40 is a "dream house" theme and the default theme object 54 is a "property for sale" sign.

Figure 5:
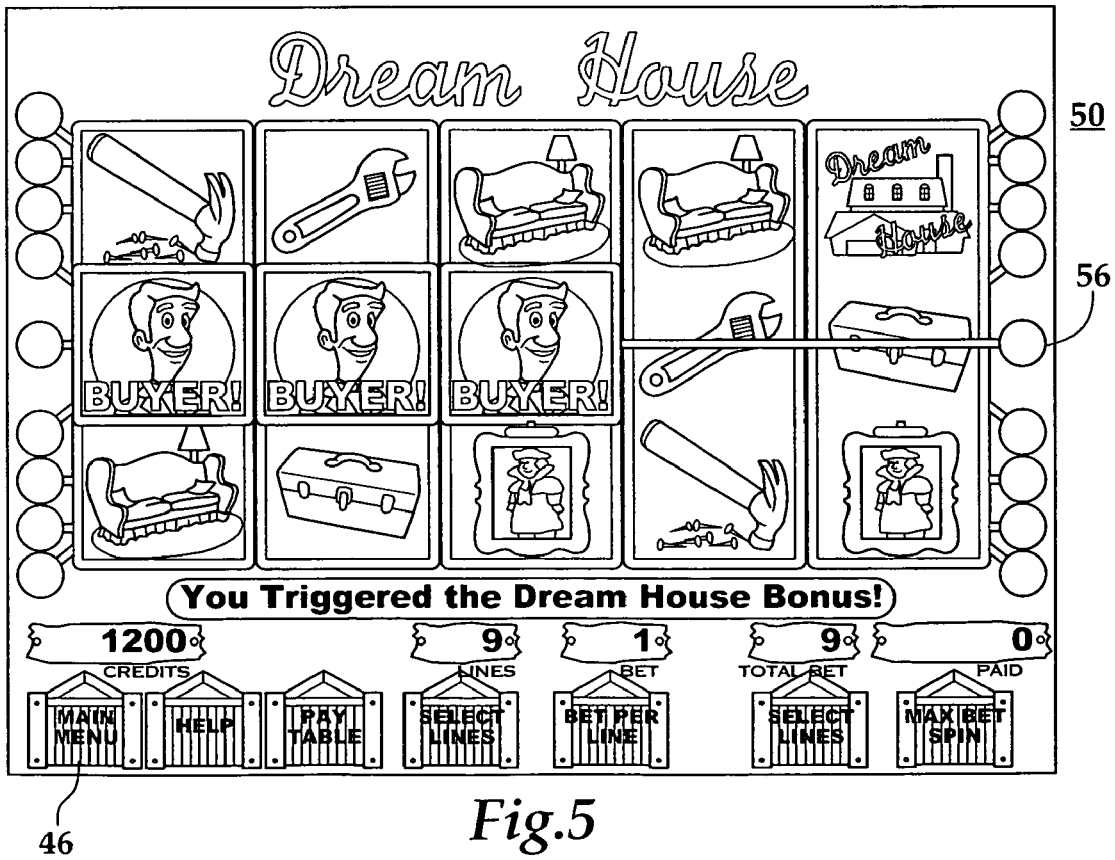
FIG. 5 illustrates an exemplary basic wagering game on the main display of the gaming terminal of FIG. 4.

FIG. 5 illustrates the main display 50 in more detail, including a close-up view of the video reels 56 of the basic wagering game. As can be seen, the basic wagering game is a video slot machine game, although other types of wagering games may certainly be used. The video slot machine 40 shown here is a typical video slot machine in that it has a number of randomly selected outcomes, including at least one start-bonus outcome. Unlike existing gaming terminals, however, one of the at least one start-bonus outcome starts a game in which the cabinet 42 of gaming terminal 40 is transformed from the basic external configuration to the bonus external configuration. At the completion of the bonus game, the gaming terminal 40 returns the cabinet 42 to the basic external configuration.

Figure 6A:
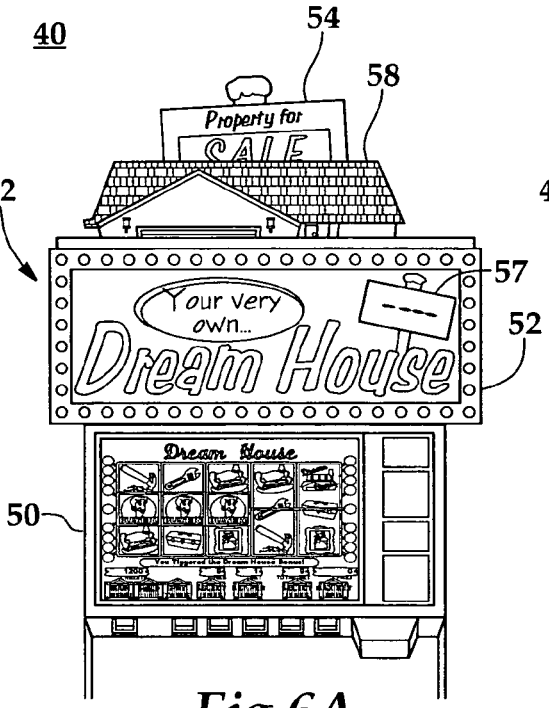
FIG. 6 illustrates the cabinet of the gaming terminal of FIG. 4 being transformed.
Figure 6B:
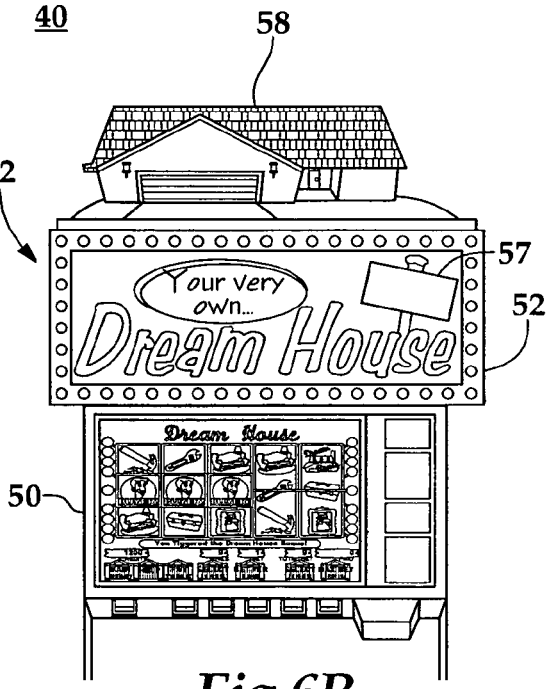

FIG. 6 illustrates the beginning of the transformation of the cabinet 42 from the basic external configuration to the bonus external configuration. As can be seen, upon occurrence of a certain start-bonus outcome (e.g., three "Buyer" symbols in a row), the "property for sale" sign 54 is retracted into the cabinet 42 and is replaced by a house 58. A status indicator 57 indicates that the house 58 has just been "sold" to the player. The house 58 may be a 2-dimensional house or it may be a 3-dimensional house. Linear actuators (not expressly shown) similar to the ones illustrated in FIG. 3 may be used to lower and raise the sign 54 and house 58 along with other theme objects. In some embodiments, the top portion 52 of the cabinet 42 may also be raised in order to house the various theme objects and then lowered at the end of the bonus game.

Figure 7:
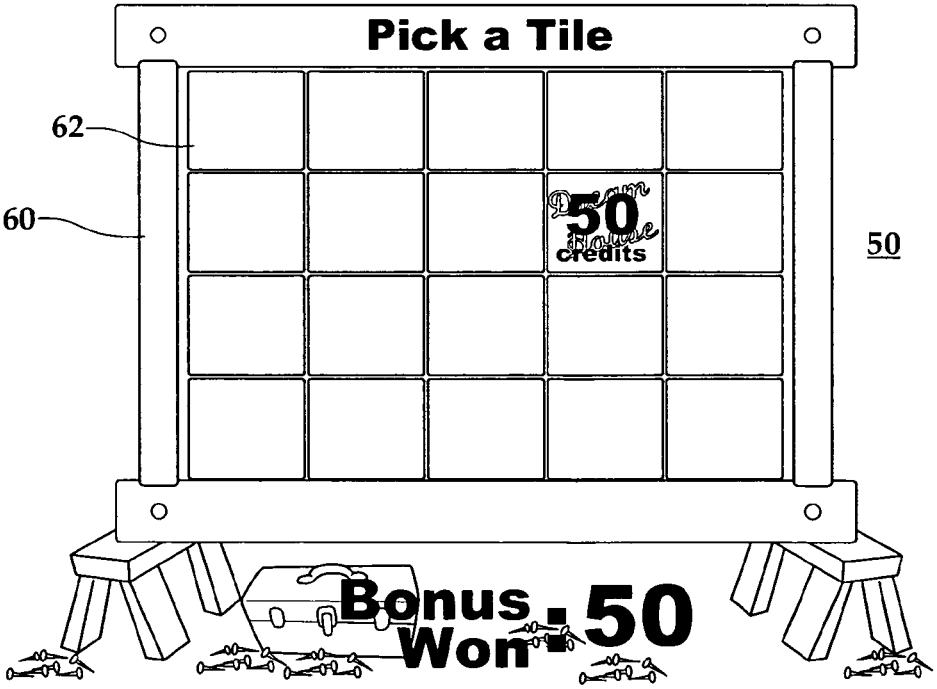
FIG. 7 illustrates an exemplary bonus game on the main display of the gaming terminal of FIG. 4.

Referring now to FIG. 7, generally coincident with the transformation of the cabinet 42, the main display 50 of the gaming terminal 40 switches from the basic wagering game (FIG. 5) to a bonus game. The bonus game in this embodiment is a "Pick a Tile" game in which players are presented with an array 60 of squares (one of which is labeled at 62) from which they may select. As each square 62 is selected, various types of prizes may be revealed to the player, including credits that are awarded outright, credits awarded in the form of "improvements" to the house 58, a number of free spins in the basic wagering game, and the like. In the example shown, the player has selected a square 62 containing 50 outright credits that will be immediately awarded to the player. For squares 62 that contain credits in the form of an improvement to the house 58, these credits will be awarded to the player at the end of the bonus game when the house 58 is sold.

Figure 8A:
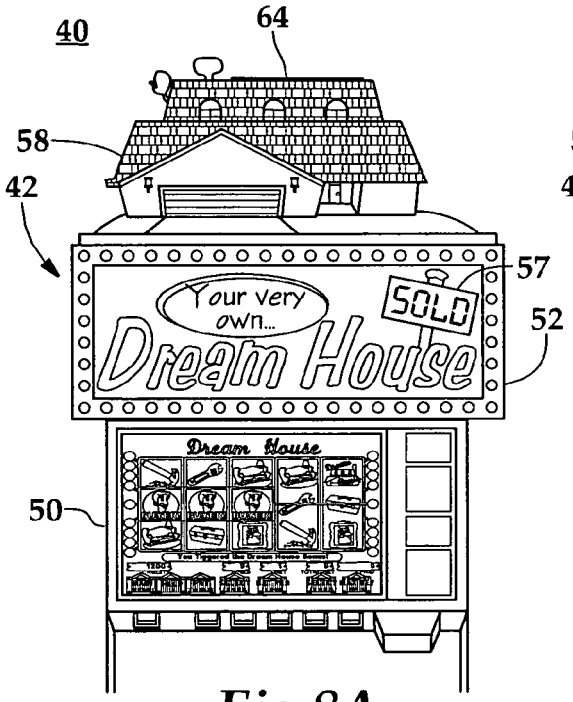
FIGS. 8-11 illustrate additional transformation of the cabinet of the gaming terminal of FIG. 4.
Figure 8B:
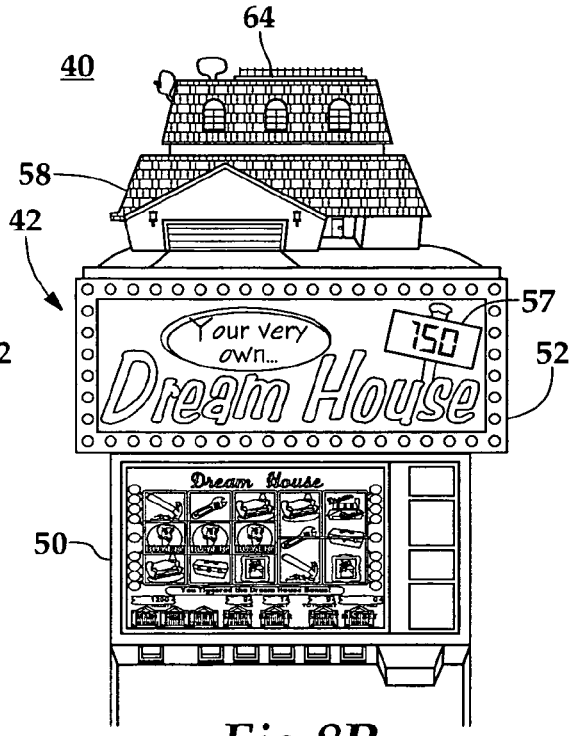
Figure 9A:
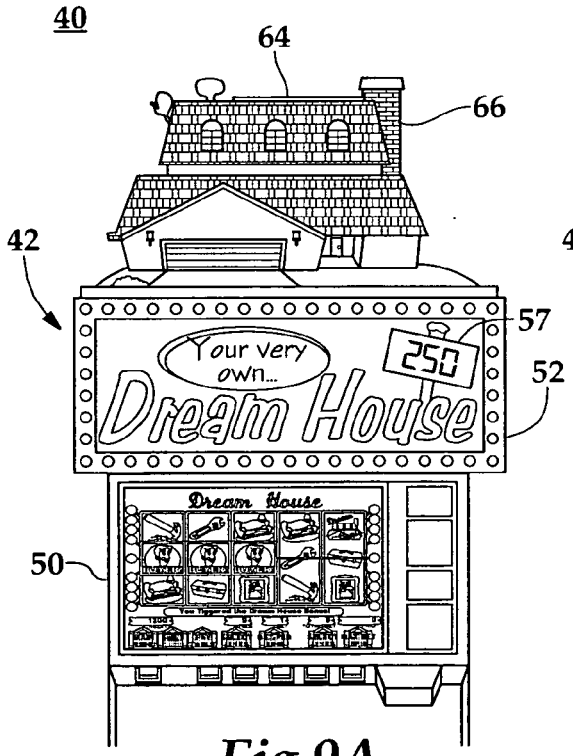
Figure 9B:
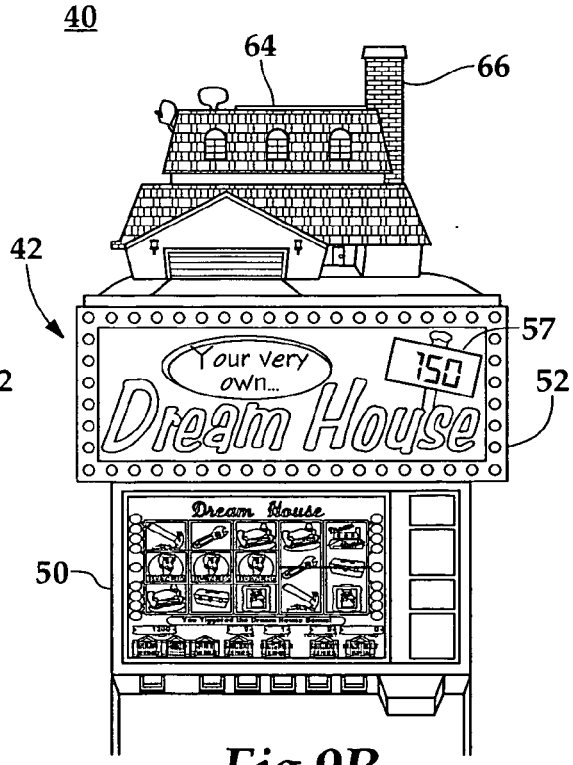
Figure 10A:
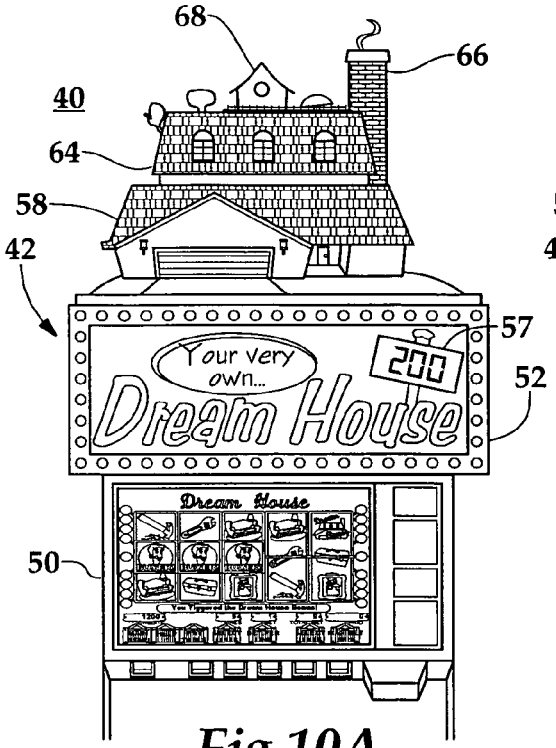
Figure 10B:
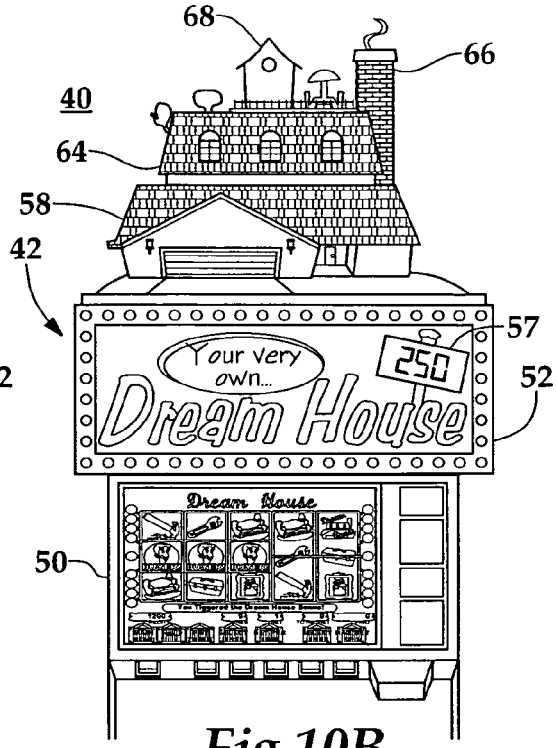
Figure 11A:
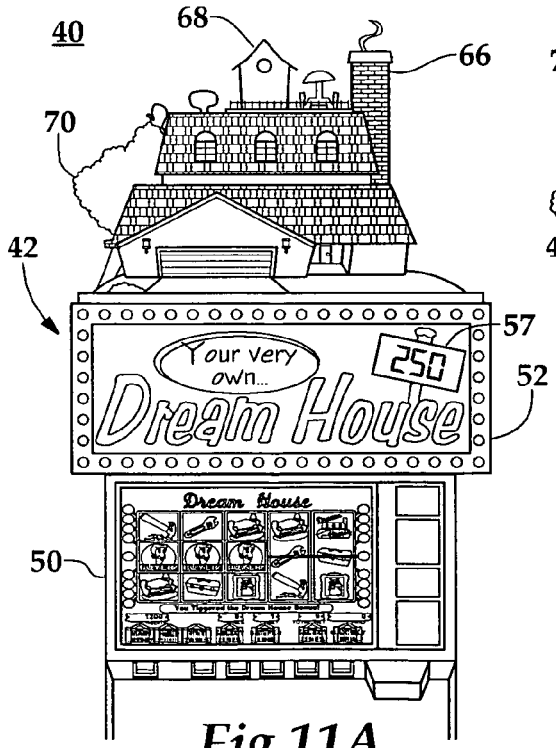
Figure 11B:
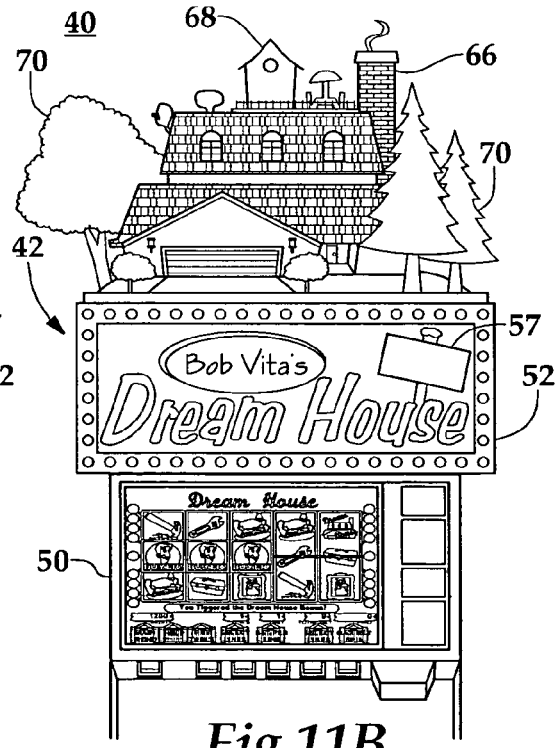

FIGS. 8-11 illustrate various types of "improvements" that may be made to the house 58 in the form of theme objects. As each improvement is won in the bonus game, the appropriate theme object for that improvement is extended from within the cabinet 42 out over the top portion 52 of the cabinet 42, and the status indicator 56 changes appropriately. In FIG. 8, for example, a second storey 64 is extended over the house 58. In FIG. 9, a chimney 66 is extended over the house 58. A rooftop patio ensemble 68 is extended over the house 58 in FIG. 10, and landscaping 70 is extended around the house 58 in FIG. 11. Note that each of these improvements may be added to the house 58 independently of the other improvements such that one does not necessarily require the others. The total value of the house 58 (as indicated by the status indicator 57), including the improvements made thereto, is then awarded to the player at the conclusion of the bonus game.

Figure 12A:
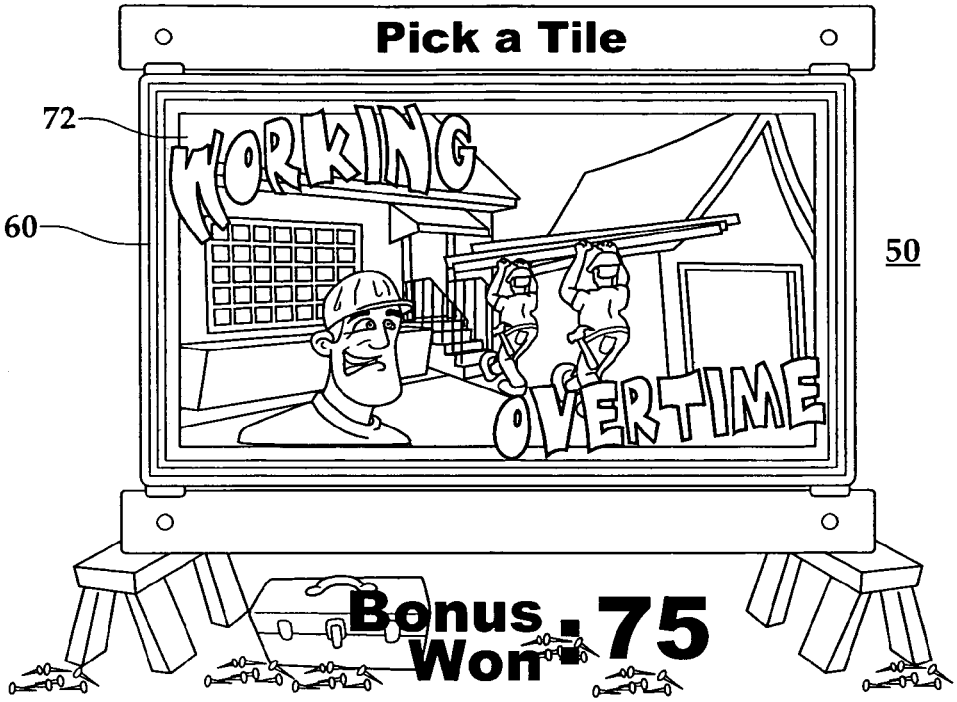
FIGS. 12A-B illustrate one possible outcome of the exemplary bonus game of FIG 7.
Figure 12B:
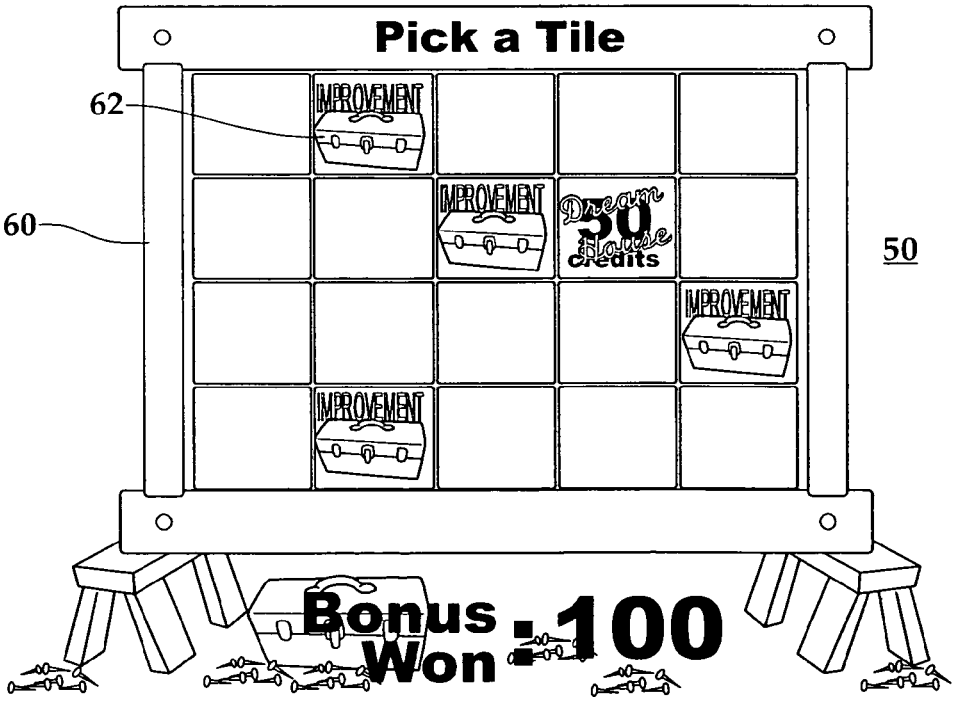

In some embodiments, instead of or in addition to the player selecting the squares 62 of the bonus game, the gaming terminal 40 may randomly award prizes to the player, including improvements that increase the value of the house 58. FIGS. 12A-B illustrate an embodiment of the invention where prizes are randomly awarded to the player. The randomly awarded prizes may be preceded by a "Working Overtime" indicator 72 that appears at randomly selected times on the main display 50, after which a randomly selected number of squares 62 may be automatically revealed to the player by the gaming terminal 40.

Figure 13:
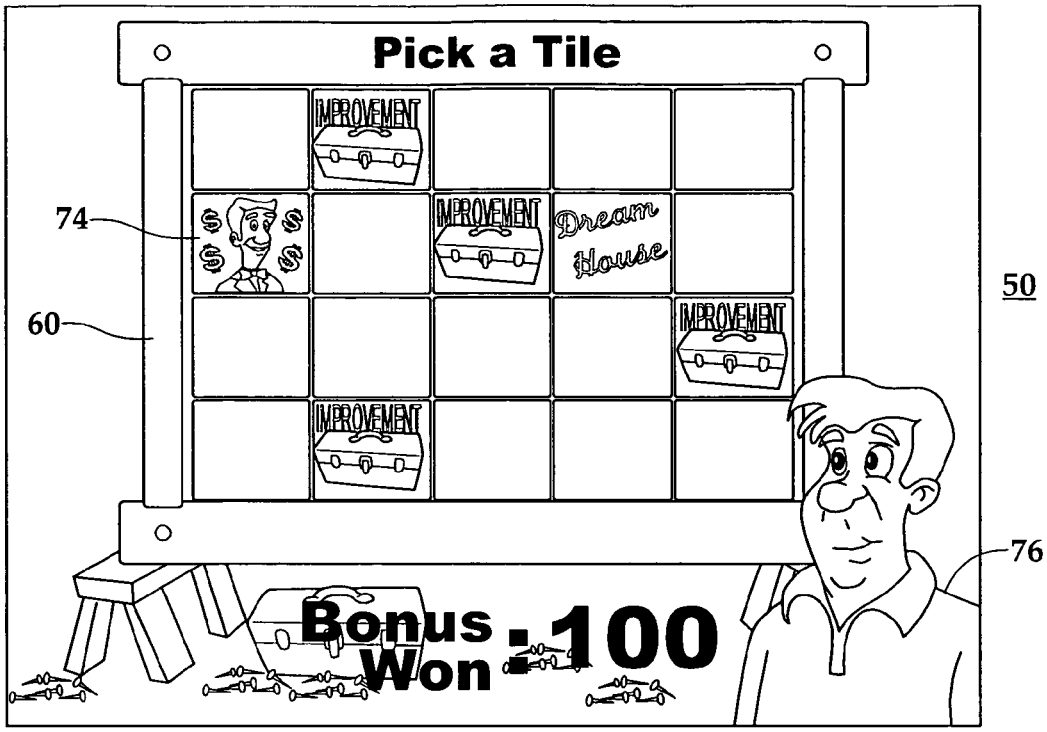
FIGS. 13-14 illustrate other possible outcomes of the exemplary bonus game of FIG. 7.

In some embodiments, the value of the house 58 may be increased by a potential "buyer" making an offer on the house. This is illustrated in FIG. 13, where the player has selected a square containing a "buyer" symbol 74 in the bonus game 60. When this happens, a potential buyer 76 appears on the main display 50 and the gaming terminal 40 automatically increases the value of the house 58 by a randomly selected amount.

Figure 14:
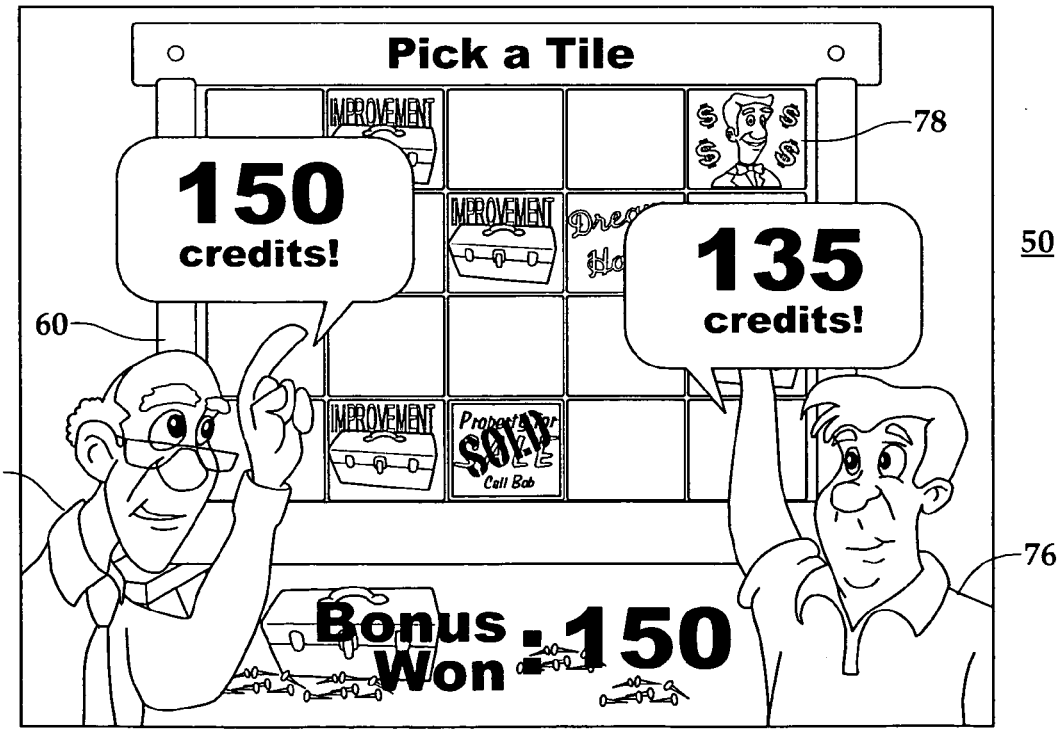

In some embodiments, the value of the house 58 may be increased by several potential buyers bidding up the price of the house 58. This is illustrated in FIG. 14, where the player has selected a square 62 containing a second "buyer" symbol 78. When this happens, a second potential buyer 80 appears on the main display 50 and the gaming terminal 40 further increases the value of the house 58 by a randomly selected amount.

The bonus game is concluded when the player selects a square 62 containing a "sold" symbol 82. When this happens, the house 58 is sold and the player is awarded credits in an amount equal to the price of the house 58, as indicated by the status indicator 57 (see FIG. 11). The gaming terminal 40 then returns the player to the basic wagering game on the main display 50.

While physical transformation of a gaming terminal cabinet has been described thus far relative to a bonus game, those having ordinary skill in the art will understand that a bonus game is not required. Any type of special event or occurrence in a wagering game may trigger the transformation of the cabinet. For example, the basic wagering game may have certain symbols on the reels (not necessarily start-bonus symbols) that correspond to the theme objects shown in FIGS. 7-12, causing the house to be transformed as certain outcomes are achieved in the basic wagering game.

Also, although the networking of the gaming terminals has not been explicitly described thus far, in some embodiments, several players (identified via their player identification cards) playing at gaming terminals that are connected over a network may to try to achieve physical transformation of the gaming terminal cabinets. For example, a certain outcome in the basic at one gaming terminal may trigger a physical transformation at several gaming terminals, or vice versa.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A gaming terminal having a physically transformable cabinet, comprising:

a first display configured to display a randomly selected outcome from a wagering game, said randomly selected outcome being selected from a plurality of outcomes in response to receiving a wager input, said plurality of outcomes including at least one special event outcome;

a cabinet having a plurality of supporting walls for housing said first display and other internal components of said gaming terminal, said cabinet having an external configuration defined by said supporting walls, said external configuration including a primary external configuration and a secondary external configuration, said primary external configuration being physically different from said secondary external configuration; and mechanical actuators mounted in said cabinet for automatically transforming said cabinet from said primary external configuration to said secondary external configuration upon occurrence of one of said at least one special event outcome in said wagering game, said transforming including extending at least one dimension of said external configuration of said cabinet as defined by said supporting walls.

2. The gaming terminal according to claim 1, wherein said secondary external configuration comprises a second display supported by said cabinet for displaying a special event, said second display moved from a concealed position to an unconcealed position by said mechanical actuators upon occurrence of one of said at least one special event outcome.

3. The gaming terminal according to claim 2, wherein said secondary external configuration further comprises an elongated top portion on said cabinet for housing said second display, said elongated top portion moved from a retracted position to an extended position by said mechanical actuators upon occurrence of one of said at least one special event outcome.

4. The gaming terminal according to claim 3, wherein said second display is a flat panel display hingedly attached to said cabinet within said elongated top portion such that said flat panel is automatically rotated from said concealed position to said unconcealed position by said mechanical actuators upon occurrence of one of said at least one special event outcome.

5. The gaming terminal according to claim 1, wherein said at least one special event outcome starts a special event in said gaming terminal, said secondary external configuration comprising a predefined theme object of said gaming terminal, said predefined theme object moved from a concealed position in said gaming terminal to an unconcealed position on top of said gaming terminal by said mechanical actuators upon starting said special event.

6. The gaming terminal according to claim 5, wherein said secondary external configuration further comprises an elongated top portion on said cabinet for housing said predefined theme object, said elongated top portion moved from a retracted position to an extended position by said mechanical actuators upon starting said special event.

7. The gaming terminal according to claim 5, wherein said secondary external configuration further comprises an additional predefined theme object, said additional predefined theme object representing a monetary value that may be awarded in said special event, said additional predefined theme object moved from a concealed position in said gaming terminal to an unconcealed position on top of said gaming terminal by said mechanical actuators upon occurrence of a certain outcome in said special event.

8. The gaming terminal according to claim 5, wherein said predefined theme object includes a physical facsimile of a dream house, said dream house having a sale price representing a monetary value that may be awarded in said special event.

9. The gaming terminal according to claim 8, wherein said additional predefined theme object includes a physical facsimile of an improvement that may be added to said dream house to increase said sale price.

10. The gaming terminal according to claim 9, wherein said improvement includes one or more of the following: a second storey for said dream house, a chimney for said dream house, landscaping for said dream house, and a rooftop patio for said dream house.

11. The gaming terminal according to claim 1, wherein said mechanical actuators are configured to transform said cabinet from said secondary external configuration back to said primary external configuration.

12. A gaming terminal having a physically transformable cabinet, comprising:

a first display configured to display a randomly selected outcome from a wagering game, said randomly selected outcome being selected from a plurality of outcomes in response to receiving a wager input, said plurality of outcomes including at least one special event outcome;

a cabinet for housing said first display and other internal components, said cabinet having an external configuration including a primary external configuration and a secondary external configuration, said primary external configuration being physically different from said secondary external configuration;

mechanical actuators mounted in said cabinet for automatically transforming said cabinet from said primary external configuration to said secondary external configuration upon occurrence of one special event outcome in said wagering game; and at least one predefined theme object extendable between a concealed position retracted within the cabinet and an unconcealed position extended on top of the cabinet, said concealed position being achieved during said primary external configuration and said unconcealed position being achieved during said secondary external configuration.

13. The gaming terminal of claim 12, wherein said at least one predefined theme object represents a feature won in response to triggering said special event outcome.

14. The gaming terminal of claim 12, wherein said at least one predefined theme object represents a prize revealed in response to triggering said special event outcome.

15. The gaming terminal of claim 12, wherein said at least one predefined theme object represents a level of monetary value to be awarded to a player.

16. The gaming terminal of claim 12, wherein said at least one predefined theme object includes a plurality of common theme objects that in combination portray a unified object.

17. The gaming terminal of claim 16, wherein each of said plurality of common theme objects is extended independently from other ones of said plurality of common theme objects.

18. The gaming terminal of claim 16, wherein said unified object is a house and said plurality of common theme objects include a second storey, a chimney, a rooftop patio ensemble, and landscaping.

19. The gaming terminal of claim 12, wherein said special event outcome includes displaying a symbol corresponding to said at least one predefined theme object.

* * * * *

UNITED STATES PATENT AND TRADEMARK OFFICE

CERTIFICATE OF CORRECTION

PATENT NO. : 7,644,922 B2
APPLICATION NO. : 11/149857
DATED : January 12, 2010
INVENTOR(S) : Fiden et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 819 days.

Signed and Sealed this

Sixteenth Day of November, 2010

David J. Kappos

David J. Kappos
*Director of the United States Patent and Trademark Office*